US005353667A

United States Patent [19]

Wilner

[11] Patent Number: 5,353,667

[45] Date of Patent: Oct. 11, 1994

[54] COMBINATION TOOL AND FASTENER

[76] Inventor: David W. Wilner, 2622 Oakview Dr., Walled Lake, Mich. 48390

[21] Appl. No.: 53,630

[22] Filed: Apr. 23, 1993

[51] Int. Cl.[5] ..... B25B 15/02

[52] U.S. Cl. ..... 81/436; 81/461

[58] Field of Search ..... 81/436, 451, 456, 460, 81/461; 411/402

[56] References Cited

U.S. PATENT DOCUMENTS

| | | | |
|---|---|---|---|
| 1,997,422 | 4/1935 | Lorenzen . | |
| 2,604,912 | 7/1952 | Walker . | |
| 2,684,094 | 7/1954 | Lissy | 81/436 |
| 2,792,039 | 5/1957 | Wing et al. | 81/436 |
| 2,800,936 | 7/1957 | West | 81/460 |
| 3,120,251 | 2/1964 | York | 81/436 |
| 3,564,740 | 2/1971 | Calfee . | |
| 3,753,454 | 8/1973 | Totsu . | |
| 4,033,244 | 7/1977 | Jacobson . | |
| 4,034,493 | 7/1977 | Ball . | |
| 4,130,152 | 12/1978 | Boleu . | |
| 4,311,071 | 1/1982 | Bassell . | |
| 4,339,971 | 7/1982 | Zattore | 81/460 X |
| 4,526,071 | 7/1985 | Post . | |
| 4,528,874 | 7/1985 | Dunn | 81/436 X |
| 4,538,486 | 9/1985 | Lutrat | 81/460 |
| 4,572,039 | 2/1986 | Desjardins . | |
| 4,936,172 | 6/1990 | Jackson | 81/451 |

*Primary Examiner*—D. S. Meislin

*Attorney, Agent, or Firm*—Gifford, Groh, Sprinkle, Patmore and Anderson

[57] ABSTRACT

A combination tool and fastener in which the fastener has a head portion and a threaded screw portion. An aperture is formed in the head portion. The aperture has a first portion of constant dimension recessed inwardly from the head portion A second portion of the aperture is recessed an additional distance beyond the end of the first portion and is increased in dimension The tool is provided with an engaging portion which is insertable through the first aperture portion and lockingly engageable within the second aperture portion so as to enable the tool to rotate the fastener in either direction.

4 Claims, 2 Drawing Sheets

COMBINATION TOOL AND FASTENER

BACKGROUND OF THE INVENTION

1. Field of the Invention

The present invention relates to fastener devices and, more particularly, to a combination tool and fastener.

2. Description of the Prior Art

Fasteners are well known in the art The most common fastener is the standard threaded screw or bolt. The screw or bolt normally has an aperture formed in its head The aperture is engaged by a screwdriver or similar tool having a similarly shaped tip. The aperture on the screw head usually conforms to a "Philips" or "American" type screwdriver.

A major shortcoming in the use of standard screw and screwdriver combinations is the stripping of the screw aperture due to the accidental disengagement of the screwdriver tip from the aperture. This commonly occurs when the screw is tightened excessively or when the screw has been in place for a long period of time and requires great effort in order to be removed. Once the screw head is stripped, it becomes difficult if not impossible to turn the screw.

A further disadvantage of conventional screw assemblies is the difficulty of maintaining the screwdriver in contact within the aperture in the screw head. This is often the result of the stripping of the screw head as previously described. However, this may also result from the inability to maintain the necessary force or balance of force on the screwdriver to keep the screwdriver tip engaged within the aperture of the screw head. This often results when the screw is located so as to make access by the screwdriver difficult.

In an attempt to address this problem, U.S. Pat. No. 4,572,039, issued to Desjardens, discloses an interlocking lock screw and screw driver. The screw head has a specially designed screw channel with entry apertures formed thereon. A specially designed screwdriver blade is provided having guide dimples which match the entry apertures The tool blade dimples are inserted in the apertures and are then slid along the slot to bring the protrusions under the lip of the channel.

The shortcoming of the Desjardins device is that the dimples in the guide blade must be dimensioned to precisely match the apertures in the screw head. The blade must further be moved along the screw head in order to engage under the lip of the channel. Also, no means are provided for securely retaining the screw blade dimples with in the channel.

SUMMARY OF THE INVENTION

The present invention is a combination tool and fastener. The fastener has a head portion and a threaded screw portion. The head portion has an aperture which is formed therein The aperture has a first portion of a constant dimension recessed a distance from the surface of the head portion. The aperture further has a second portion of an increased dimension with respect to the first portion and which is recessed an additional distance beyond the recessed distance of the first portion.

The engaging tool has a body portion and an engaging portion. The engaging portion is capable of being inserted within the first portion of the aperture and lockingly engaged with the second portion of the aperture. Accidental disengagement of the engaging portion of the tool from the second portion of the aperture is thus prevented during rotation of the fastener by the tool.

BRIEF DESCRIPTION OF THE DRAWINGS

A better understanding of the embodiments of the invention will become apparent upon reference to the accompanying drawings wherein like reference numerals refer to like elements throughout and in which.

DESCRIPTION OF THE PREFERRED EMBODIMENT

Figure 1:
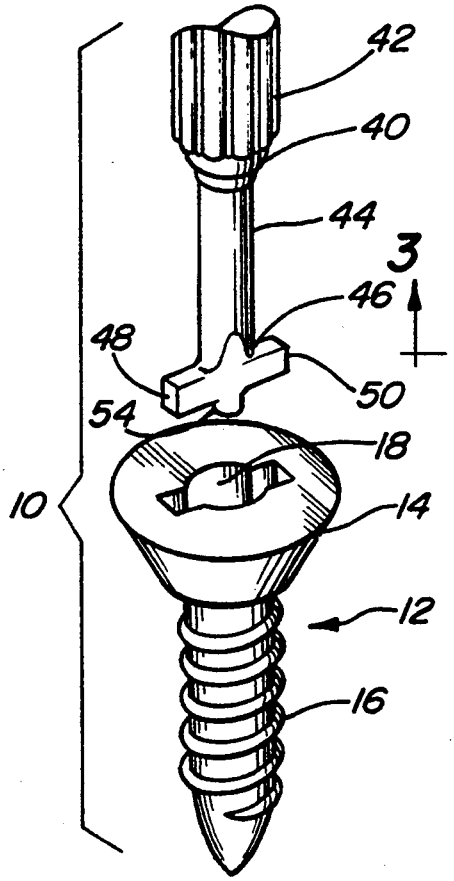
FIG. 1 is an elevational view of a first embodiment of the tool and fastener combination of the present invention.

Referring to FIG. 1, a combination tool and fastener is shown, indicated at 10. A fastener 12 has a head portion 14 and a threaded screw portion 16. The head portion 14 has an aperture 18 formed therein.

Figure 2:
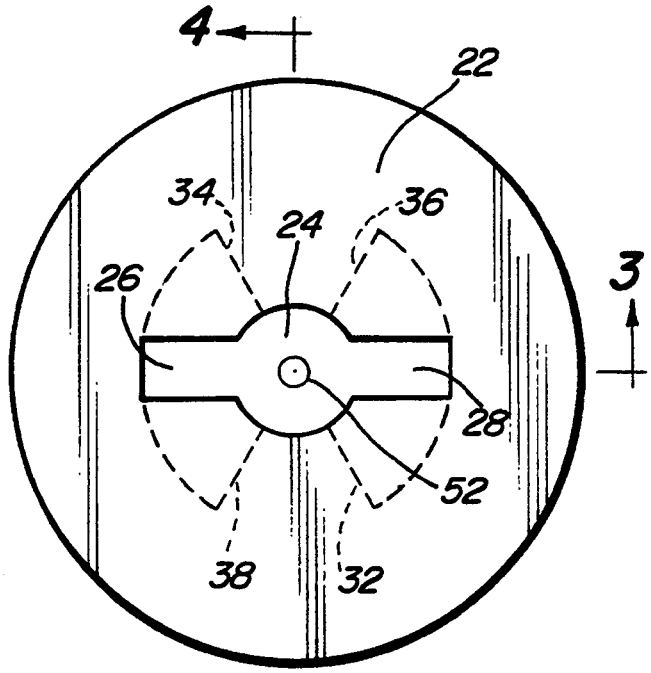
FIG. 2 is a cross-sectional view of the fastener head of the embodiment of FIG. 1 showing the first aperture portion in solid outline and the expanded second aperture portion in phantom.
Figure 3:
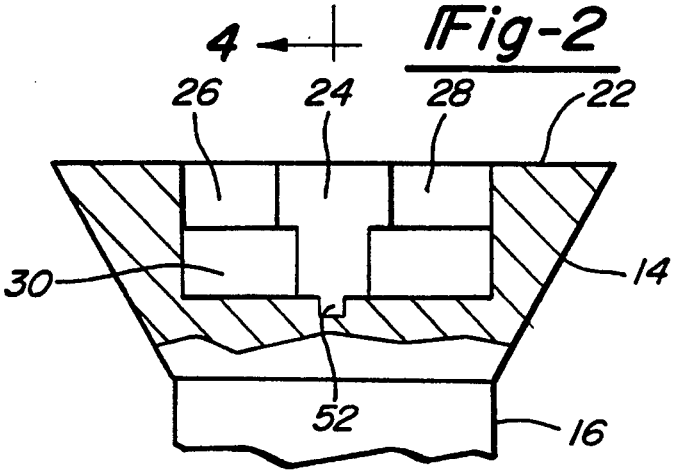
FIG. 3 is a cross-sectional view taken along line 3—3 of FIG. 2 and showing a first view of the screw aperture.
Figure 4:
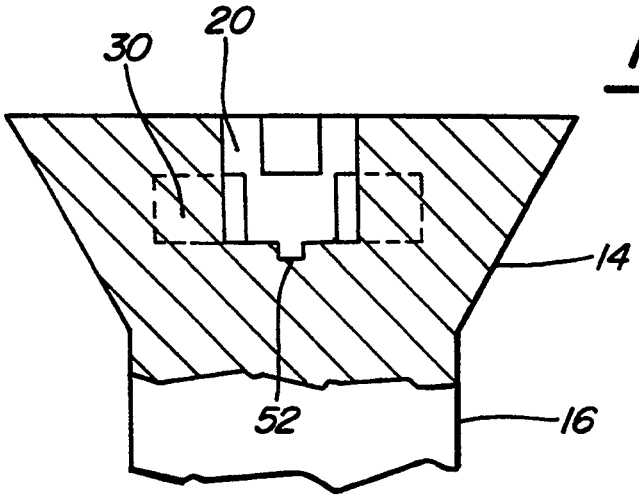
FIG. 4 is a cross-sectional view taken along line 4—4 of FIG. 2 and showing a second view of the screw aperture.
Figure 5:
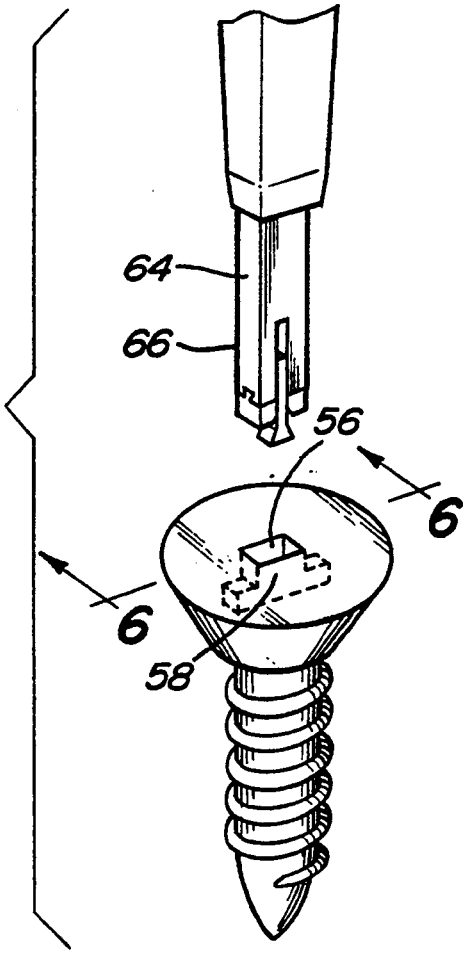
FIG. 5 is an elevational view of a second embodiment of the tool and fastener combination of the present invention and showing the screw aperture in phantom.

Referring to FIGS. 2–4, the aperture 18 has a first portion 20 which is recessed inwardly from a surface 22 of the head portion 14. The first portion 20 of the aperture 18 is of a given shape and dimension and as best seen in FIGS. 4 and 5 is recessed a distance into the head portion 14 of the fastener 12 In a preferred embodiment, the first portion 20 has a circular central portion 24 and rectangular projecting portions 26 and 28.

The fastener aperture 18 further has a second portion 30 recessed an additional distance beyond the first portion 20 and away from the surface 22 of the fastener head 14. Referring again to FIG. 2, as shown in phantom the second aperture portion 30 is of the same overall shape diameter as the first portion 20, but is increased in its angular dimension with respect to the first portion 20. The edges of the second portion 30 are defined by walls 32, 34, 36 and 38.

As best seen in FIG. 1 a tool 40 is provided for turning the fastener 12 The tool 40 has a handle portion 42, a body portion 44, and an engaging portion 46. The tool 40 may alternatively be a drill bit without the handle portion which is insertable within a drill bit of a standard drill. The body portion 44 is of constant diameter from the handle to the engaging portion 46 and is insertable within the central portion 24 of the screw aperture 18.

The engaging portion 46 of the tool 40 consists of a pair of wings 48 and 50 which extend radially outward from the body portion 44. The wings 48 and 50 of the tool 40 are inserted through the aperture 18 until they are aligned with the second aperture portion 30. Referring again to FIGS. 2–4 the tool 40 is then rotated in either a clockwise or a counterclockwise direction until the wings 48 and 50 engage the walls 32 and 34 or 36 and 38 (FIG. 2) of the second aperture portion 30. Once rotated, the tool 40 is lockingly engaged in the fastener 12 and may be turned in either direction without slippage of the engaging portion 46 or stripping of the fastener aperture 18.

Referring again to FIGS. 3 and 4, the aperture 18 may have a third portion 52 recessed a distance beyond the second portion 30 and opposite the first portion 20. The third portion 52 is cylindrical in shape with a circular cross-section and is of a diameter smaller than the central portion 24 of the aperture 18.

Referring again to FIG. 1, the tool 44 may be provided with a corresponding tip portion 54 which engages the third aperture portion 52 when the engaging portion 46 is inserted into the aperture 18. The third aperture portion 52 and engaging tip portion 54 provide additional support and stability to the tool 40 when turning the fastener 12.

Figure 6:
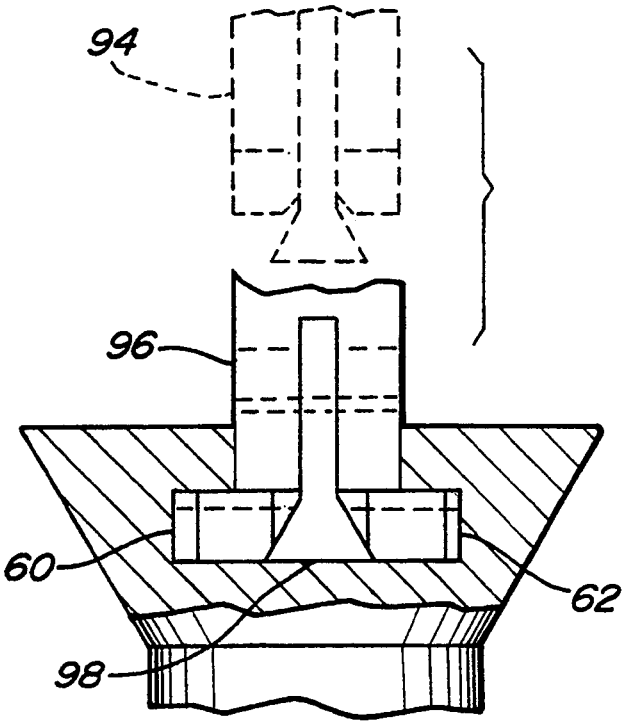
FIG. 6 is a cross-sectional view taken along line 6—6 of FIG. 5 and showing the engaging tool both before and after insertion within the aperture.
Figure 7:
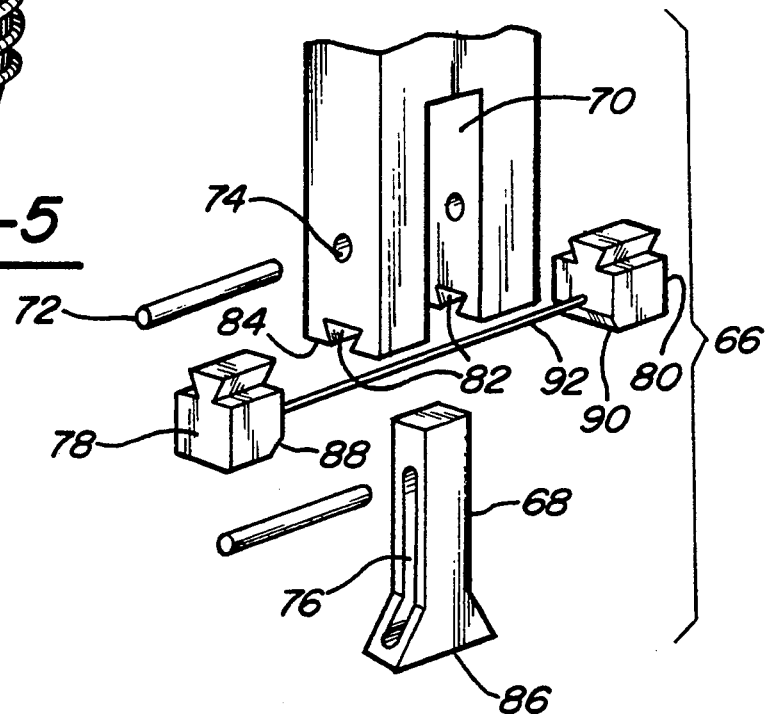
FIG. 7 is an exploded view of the engaging portion of the combination tool and fastener of FIG. 5

Referring to FIGS. 5–7, a second embodiment of the combination tool and fastener is shown The fastener in this embodiment is similar to that previously disclosed, with the exception that first and second aperture portions 56 and 58 formed in the screw head 14 are rectangular in shape. The second aperture portion 58 is defined by walls 60 and 62 which define a greater dimension than the first aperture portion 56.

The tool of this embodiment has a rectangular body portion 64 and a fastener engaging portion 66. As best seen in FIG. 7 a central member 68 is supported within a vertically extending opening 70 formed in the engaging portion 66. A pin 72 is insertable through an opening 74 provided in the engaging portion 66 and extends into a channel 76 formed through substantially the entire length of the member 68. The member 68 is depressible toward the opening 70 of the tool A pair of laterally displaceable members 78 and 80 are provided and have grooves formed along their upper surfaces which secure within slots 82 formed on a lower surface 84 of the engaging portion 66. The central member 68 has an outwardly flared lower portion 86 which engages chamfered surfaces 88 and 90 on the displaceable members 78 and 80. The central member 68 is depressible toward the opening 70 and urges the members 78 and 80 radially outwardly.

A biasing coil 92 extends through the channel 76 of the central member 68 and connects the displaceable members 78 and 80. The biasing coil 92 biases the members 78 and 80 toward each other to maintain them within the cross-section of the tool body portion 64 prior to engagement by the central member 68.

In operation, when the tool is in a first position 94, as shown in FIG. 6, the central member 68 is fully extended beneath the opening 70 and the displaceable members 78 and 80 are fully retracted so as to have a cross section no greater than that of the body portion 64 of the tool. The tool is inserted through the aperture first portion 56 and into the second portion 58 In a second position 96, also as shown in FIG. 6, the member 68 engages a bottom surface 98 of the portion 58 and depresses inwardly toward the opening 70. The flared lower portion 86 engages the chamfered surfaces 88 and 90 of the members 78 and 80 and cause the members to displace outwardly and to fully engage within the recess of the second aperture portion 58.

An upward force is exerted on the tool to remove it from within the fastener. The second aperture portion 58 is of a sufficient depth to allow the flared lower surface to displace a predetermined distance away from the radially-displaceable members. The biasing coil 92 then withdraws the displaceable members 78–80 within the cross-section of the tool body to permit the tool to be removed.

As can be seen the present invention in its several embodiments provides a fastener and tool combination which provides a secure engagement between the tool and the fastener eliminating the problem of accidental disengagement during the tightening and loosening process.

It is apparent that changes and modifications can be made to the disclosed embodiments without departing from the spirit of the invention and the scope of the appended claims.

I claim:

1. A combination tool and fastener, comprising:

said fastener having a heat having a top surface and a threaded screw portion;

an aperture formed in said head, said aperture having a first portion comprised of a pair of rectangular slot-shaped portions;

said aperture having a second portion extending under said top surface and defining a pair of recesses, each recess having a pair of side walls which are angularly offset from said slot-shaped portions; and said tool having an engaging portion, said engaging portion including a shaft portion and a pair of oppositely extending wing portions having parallel planar walls which are insertable through said first portion of said aperture and are rotatable in a selected rotational direction within said second aperture portion so that said wing portions abut against two of said of side walls, said engaging portion lockingly engaging with said second aperture portion whereby accidental disengagement of said engaging portion from said aperture is prevented during turning of said fastener by said tool.

2. The combination tool and fastener of claim 1, said aperture further comprising a third portion of circular cross-section recessed beyond said second portion opposite said first portion, said engaging portion of said tool having a like-shaped tip portion insertable within said third portion of said aperture to stabilize said tool when said wings are rotated within said second portion.

3. The combination tool and fastener of claim 1, wherein said tool is a drill bit for turning said fastener.

4. The combination tool and fastener of claim 1, wherein said tool has a handle for manual turning of said fastener.

* * * * *

UNITED STATES PATENT AND TRADEMARK OFFICE

CERTIFICATE OF CORRECTION

PATENT NO. : 5,353,667
DATED : October 11, 1994
INVENTOR(S) : David W. Wilner

It is certified that error appears in the above-indentified patent and that said Letters Patent is hereby corrected as shown below:

Column 1, line 9, after "art" insert --.--.

Column 1, line 12, after "head" insert --.--.

Column 1, line 42, after "aperatures insert --.--.

Column 1, line 51, delete "with in" and substitute therefor --within--.

Column 2, line 42, after "12" insert --.--.

Column 2, line 56, after "12" insert --.--.

Column 3, line 38, after "tool" insert --.--.

Column 3, line 60, after "58" insert --.--.

Column 4, line 27, delete "heat" and substitute therefor --head--.

Signed and Sealed this

Eighteenth Day of April, 1995

Bruce Lehman

*Attest:*

BRUCE LEHMAN

*Commissioner of Patents and Trademarks*

*Attesting Officer*